US009568876B2

(12) United States Patent
Ogawa et al.

(10) Patent No.: US 9,568,876 B2
(45) Date of Patent: Feb. 14, 2017

(54) DAMAGE AMOUNT DETERMINATION DEVICE, IMAGE FORMING DEVICE, COMPUTER-READABLE RECORDING MEDIUM STORING DAMAGE AMOUNT DETERMINATION PROGRAM, AND DAMAGE AMOUNT DETERMINATION METHOD

(71) Applicant: KONICA MINOLTA, INC., Chiyoda-ku (JP)

(72) Inventors: Shinji Ogawa, Toyokawa (JP); Yu Mukobayashi, Toyokawa (JP); Yasuyuki Inada, Toyohashi (JP); Masato Kimura, Toyoake (JP); Yuusuke Mandai, Kyoto (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 14/587,026

(22) Filed: Dec. 31, 2014

(65) Prior Publication Data

US 2015/0192886 A1 Jul. 9, 2015

(30) Foreign Application Priority Data

Jan. 7, 2014 (JP) ..... 2014-000712

(51) Int. Cl.
*G03G 15/00* (2006.01)

(52) U.S. Cl.
CPC ..... *G03G 15/55* (2013.01); *G03G 15/5029* (2013.01)

(58) Field of Classification Search
CPC G03G 15/5029; G03G 15/55; G03G 15/5062; G03G 15/553; G03G 15/5079; G03G 15/556; G03G 15/0863; G03G 21/0094
See application file for complete search history.

(56) References Cited

U.S. PATENT DOCUMENTS 5,710,957 A * 1/1998 Acquaviva ..... G03G 15/23 399/45
2005/0078973 A1 4/2005 Suzuki
(Continued)

FOREIGN PATENT DOCUMENTS

JP 2001-056627 2/2001
JP 2001056627 A * 2/2001
(Continued)

OTHER PUBLICATIONS

Notice of Reasons for Rejection issued in corresponding Japanese Patent Application No. 2014-000712; dated Dec. 15, 2015; with English Translation (15 pages).
(Continued)

*Primary Examiner* — Francis Gray
(74) *Attorney, Agent, or Firm* — Buchanan Ingersoll & Rooney PC

(57) ABSTRACT

A damage amount determination device, which is used for an image forming device that forms an image on paper, includes an information acquisition unit that acquires information related to whiteness of the paper used for printing and a damage amount determination unit that determines an amount of damage, which is caused by the paper to a predetermined component of the image forming device when the paper passes through the predetermined component, based on the information related to the whiteness.

20 Claims, 8 Drawing Sheets

(56) References Cited

U.S. PATENT DOCUMENTS

| | | | | |
|---|---|---|---|---|
| 2009/0110419 | A1 | 4/2009 | Suzuki et al. | |
| 2009/0244566 | A1* | 10/2009 | Jackson | G03G 15/167 358/1.9 |
| 2010/0309488 | A1* | 12/2010 | Koyama | G03G 15/5029 369/103 |
| 2012/0155908 | A1* | 6/2012 | Ito | G03G 15/6585 399/81 |
| 2013/0177330 | A1 | 7/2013 | Aoki | |
| 2013/0223872 | A1* | 8/2013 | Aiba | G03G 21/0011 399/101 |

FOREIGN PATENT DOCUMENTS

| | | | | |
|---|---|---|---|---|
| JP | 2003-149906 | A | | 5/2003 |
| JP | 2005-070508 | | | 3/2005 |
| JP | 2005350193 | A | * | 12/2005 |
| JP | 2008-026717 | A | | 2/2008 |
| JP | 2008-290810 | | | 12/2008 |
| JP | 2009-020370 | A | | 1/2009 |
| JP | 2009-134270 | | | 6/2009 |
| JP | 2011-137963 | A | | 7/2011 |
| JP | 2013-142801 | | | 1/2012 |
| JP | 2013242351 | A | * | 12/2013 |

OTHER PUBLICATIONS

Office Action (Notification of Reasons for Rejection) issued on Oct. 18, 2016, by the Japanese Patent Office, in corresponding Japanese Patent Application No. 2014-000712, and an English language translation of the Office Action (10 pages).

* cited by examiner

DAMAGE AMOUNT DETERMINATION DEVICE, IMAGE FORMING DEVICE, COMPUTER-READABLE RECORDING MEDIUM STORING DAMAGE AMOUNT DETERMINATION PROGRAM, AND DAMAGE AMOUNT DETERMINATION METHOD

The entire disclosure of Japanese Patent Application No. 2014-000712 filed on Jan. 7, 2014 including description, claims, drawings, and abstract are incorporated herein by reference in its entirety.

BACKGROUND OF THE INVENTION

Field of the Invention

The present invention relates to a damage amount determination device, an image forming device, a computer-readable recording medium storing a damage amount determination program, and a damage amount determination method, more specifically, to a damage amount determination device, an image forming device, a computer-readable recording medium storing a damage amount determination program, and a damage amount determination method, which determine an amount of damage caused by paper to a predetermined component of an image forming device.

Description of the Related Art

In general, high-quality paper is used as a print medium of an image forming device. Bleached pulp is used for the high-quality paper. Therefore, in the high-quality paper, the addition amount of white filler that increases the whiteness is small.

By the way, the use of recycled paper as a print medium increases year by year due to the heightened awareness of the environmental problems in recent years. To enhance environmental protection and use of waste paper, moves such as raising the blending ratio of the waste paper in the recycled paper and reviewing the whiteness of paper are becoming active.

In the standard for goods qualified by Green Purchasing Law and the accreditation criteria of Eco Mark, the whiteness of paper is prescribed as an item of criteria. For example, for the recycled paper, ISO whiteness is set to about 70% which is lower than a normal ISO whiteness of 80%. According to the recycled paper having an ISO whiteness of about 70% (hereinafter simply referred to as recycled paper), it is possible to reduce burden on both the environment and the quality. Specifically, according to the recycled paper, it is possible to maintain the quality by pursuing the ISO whiteness to the extent not to cause any problem in use. Further, it is possible to reduce the environmental burden due to a bleaching process because of reduction of the white filler and it is also possible to reduce the environmental burden by using the waste paper.

On the other hand, in recent years, chances to use paper imported from abroad (hereinafter referred to imported paper) are increasing. To obtain whiteness and opacity, more white filler is added to such imported paper than that added to the high-quality paper and the recycled paper.

The three types of paper as described above cause different amounts of damage to consumables such an intermediate transfer belt and a fixing roller when the paper passes through the consumables in an image forming device. More specifically, for example, calcium carbonate is used as the white filler. The particle size of the calcium carbonate is large, and the particle is hard and has sharp points. Therefore, when the paper passes through the consumables of the image forming device, if the paper is pressed against the consumables, the white filler causes damage to the consumables. Therefore, the imported paper containing a relatively large amount of white filler causes an amount of damage to the consumables, which is greater than the amount of damage caused by the high-quality paper and the recycled paper.

However, a conventional image forming device manages the lifetimes of consumables by the number of printed sheets of paper and does not manage the lifetimes of consumables by considering the types of printed sheets of paper. Therefore, the lifetimes of the consumables are set based on paper that causes a relatively large amount of damage. Thus, when many sheets of paper that causes a relatively small amount of damage, such as the high-quality paper and the recycled paper, are printed, there is a risk that the image forming device determines that a lifetime of a consumable is ended and prompts to replace the consumable even though the lifetime of the consumable is not actually ended. Therefore, it is desired that the image forming device identifies the type of paper, determines the amount of damage according to the type of paper, and accurately manages the lifetimes of consumables.

As a method of identifying the type of paper, for example, there is a method of checking the amount of paper powder generated when conveying the paper. More specifically, a relatively small amount of paper powder is generated when conveying the high quality paper and the recycled paper. On the other hand, a relatively large amount of paper powder is generated when conveying the imported paper. Therefore, it can be considered to identify the type of paper by checking the amount of paper powder generated from the paper when conveying the paper. As an invention for checking the amount of paper powder generated from paper when conveying the paper, for example, an electrophotographic printing device described in JP 2009-20370 A is known.

SUMMARY OF THE INVENTION

An object of the present invention is to newly provide a damage amount determination device, an image forming device, a damage amount determination program, and a damage amount determination method, which can determine the amount of damage caused by paper to a predetermined component of an image forming device.

To achieve at least the abovementioned object, according to an aspect, a damage amount determination device, which is used for an image forming device that forms an image on paper, reflecting one aspect of the present invention comprises an information acquisition unit that acquires information related to whiteness of the paper used for printing, and a damage amount determination unit that determines an amount of damage, which is caused by the paper to a predetermined component of the image forming device when the paper passes through the predetermined component, based on the information related to the whiteness.

To achieve at least the abovementioned object, according to an aspect, an image forming device reflecting one aspect of the present invention comprises the damage amount determination device.

To achieve at least the abovementioned object, according to an aspect, a non-transitory recording medium storing a computer readable program which determines a damage amount and is executed in a damage amount determination device used for an image forming device that forms an image on paper, reflecting one aspect of the present invention causes the damage amount determination device to execute a step of acquiring information related to whiteness of the paper used for printing, and a step of determining an amount of damage, which is caused by the paper to a predetermined component of the image forming device when the paper passes through the predetermined component, based on the information related to the whiteness.

To achieve at least the abovementioned object, according to an aspect, a damage amount determination method, which is performed in an image forming device that forms an image on paper, reflecting one aspect of the present invention comprises a step of acquiring information related to whiteness of the paper used for printing, and a step of determining an amount of damage, which is caused by the paper to a predetermined component of the image forming device when the paper passes through the predetermined component, based on the information related to the whiteness.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an image forming device including a damage amount determination device according to an embodiment of the present invention will be described with reference to the drawings. However, the scope of the invention is not limited to the illustrated examples.

(Configuration of Image Forming Device)

Figure 1:
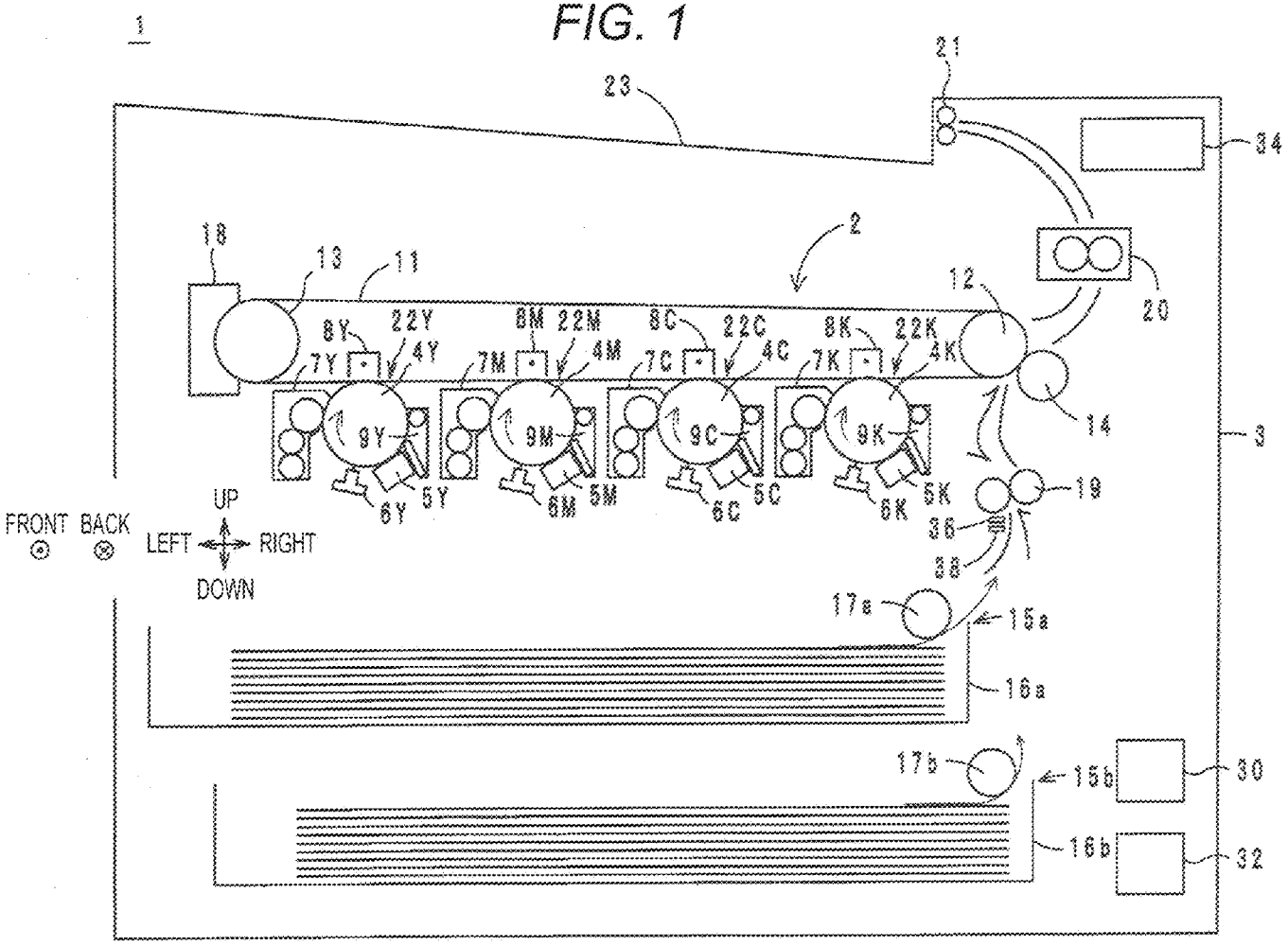
FIG. 1 is a diagram showing an entire configuration of an image forming device.

Hereinafter, the image forming device according to the embodiment of the present invention will be described with reference to the drawings. FIG. 1 is a diagram showing an entire configuration of the image forming device 1. In FIG. 1, the horizontal direction of the page is simply referred to as the horizontal direction, the front-back direction of the page is simply referred to as the front-back direction, and the vertical direction of the page is simply referred to as the vertical direction.

The image forming device 1 is an electrophotographic color printer, which is configured to synthesize a four-color (Y: yellow, M: magenta, C: cyan, and K: black) image by a so-called tandem method. The image forming device 1 has a function to form an image on paper (print medium) based on image data read by a scanner. As shown in FIG. 1, the image forming device 1 includes a printing unit 2, a main body 3, paper feed cassettes 15*a* and 15*b*, a timing roller pair 19, a fixing unit 20, a paper discharge roller pair 21, a paper discharge tray 23, a control unit 30, a storage unit 32, a touch panel 34, a whiteness detection unit 36, and a paper powder amount detection unit 38.

The main body 3 is a housing of the image forming device 1. The main body 3 houses the printing unit 2, the paper feed cassettes 15*a* and 15*b*, the timing roller pair 19, the fixing unit 20, the paper discharge roller pair 21, the control unit 30, the storage unit 32, the touch panel 34, the whiteness detection unit 36, and the paper powder amount detection unit 38.

The paper feed cassette 15*a* plays a role of supplying sheets of paper one by one. The paper feed cassette 15*a* substantially includes a paper tray 16*a* and a paper feed roller 17*a*. A plurality of sheets of paper before printing are stacked and placed on the paper tray 16*a*. The paper feed roller 17*a* takes out the sheets of paper placed on the paper tray 16*a* one by one.

The paper feed cassette 15*b* plays a role of supplying sheets of paper one by one. The paper feed cassette 15*b* substantially includes a paper tray 16*b* and a feed roller 17*b*. A plurality of sheets of paper before printing are stacked and placed on the paper tray 16*b*. The paper feed roller 17*b* takes out the sheets of paper placed on the paper tray 16*b* one by one.

The timing roller pair 19 conveys a sheet of paper conveyed from the paper feed cassette 15*a* or 15*b* while adjusting timing so that a toner image is secondarily transferred to the paper in the printing unit 2.

The printing unit 2 forms a toner image on the paper conveyed from the paper feed cassette 15*a* or 15*b*. The printing unit 2 includes imaging units 22Y, 22M, 22C, and 22K, optical scanning devices 6Y, 6M, 6C, and 6K, transfer units 8Y, 8M, 8C, and 8K, an intermediate transfer belt 11, a driving roller 12, a driven roller 13, a secondary transfer roller 14, and a cleaning device 18. The imaging units 22Y, 22M, 22C, and 22K include photoreceptor drums 4Y, 4M, 4C, and 4K, charging units 5Y, 5M, 5C, and 5K, developing devices 7Y, 7M, 7C, and 7K, and cleaners 9Y, 9M, 9C, and 9K.

The photoreceptor drums 4Y, 4M, 4C, and 4K are provided in the main body 3 and have a cylindrical shape. The photoreceptor drums 4Y, 4M, 4C, and 4K are rotated clockwise in FIG. 1. The charging units 5Y, 5M, 5C, and 5K charge circumferential surfaces of the photoreceptor drums 4Y, 4M, 4C, and 4K. The optical scanning devices 6Y, 6M, 6C, and 6K scan the circumferential surfaces of the photoreceptor drums 4Y, 4M, 4C, and 4K with beams BY, BM, BC, and BK by control of the control unit 30. Thereby, electrostatic latent images are formed on the circumferential surfaces of the photoreceptor drums 4Y, 4M, 4C, and 4K.

The developing devices 7Y, 7M, 7C, and 7K are provided in the main body 3. The developing devices 7Y, 7M, 7C, and 7K supply toner to the photoreceptor drums 4Y, 4M, 4C, and 4K and develop toner images based on the electrostatic latent images.

The intermediate transfer belt 11 is stretched between the driving roller 12 and the driven roller 13. The toner images developed on the photoreceptor drums 4Y, 4M, 4C, and 4K are primarily transferred to the intermediate transfer belt 11. The transfer units 8Y, 8M, 8C, and 8K are arranged so as to face the inner circumferential surface of the intermediate transfer belt 11 and play a role of primarily transferring the toner images formed on the photoreceptor drums 4Y, 4M, 4C, and 4K to the intermediate transfer belt 11. The cleaners 9Y, 9M, 9C, and 9K collect toner remaining on the circumferential surfaces of the photoreceptor drums 4Y, 4M, 4C, and 4K after the primary transfer. The driving roller 12 is rotated by an intermediate transfer belt driving unit (not shown in FIG. 1), so that the driving roller 12 drives the intermediate transfer belt 11 counterclockwise. Thereby, the intermediate transfer belt 11 conveys the toner images to the secondary transfer roller 14.

The secondary transfer roller 14 faces the intermediate transfer belt 11 and has a drum shape. When a transfer voltage is applied to the secondary transfer roller 14, the secondary transfer roller 14 secondarily transfers a toner image carried by the intermediate transfer belt 11 to the paper passing between the secondary transfer roller 14 and the intermediate transfer belt 11. The cleaning device 18 removes toner remaining on the intermediate transfer belt 11 after the toner image is secondarily transferred to the paper.

The paper on which the toner image is secondarily transferred is conveyed to the fixing unit 20. The fixing unit 20 fixes the toner image to the paper by performing heat treatment and pressure treatment on the paper.

The paper discharge roller pair 21 discharges the paper that has passed through the fixing unit 20 onto the paper discharge tray 23. The printed paper is stacked on the paper discharge tray 23.

The control unit 30 includes, for example, a CPU, and controls an operation of the image forming device 1. The storage unit 32 includes, for example, a non-volatile memory, and stores two types of tables described later. The touch panel 34 is an input unit and a display unit of the image forming device 1.

Figure 2:
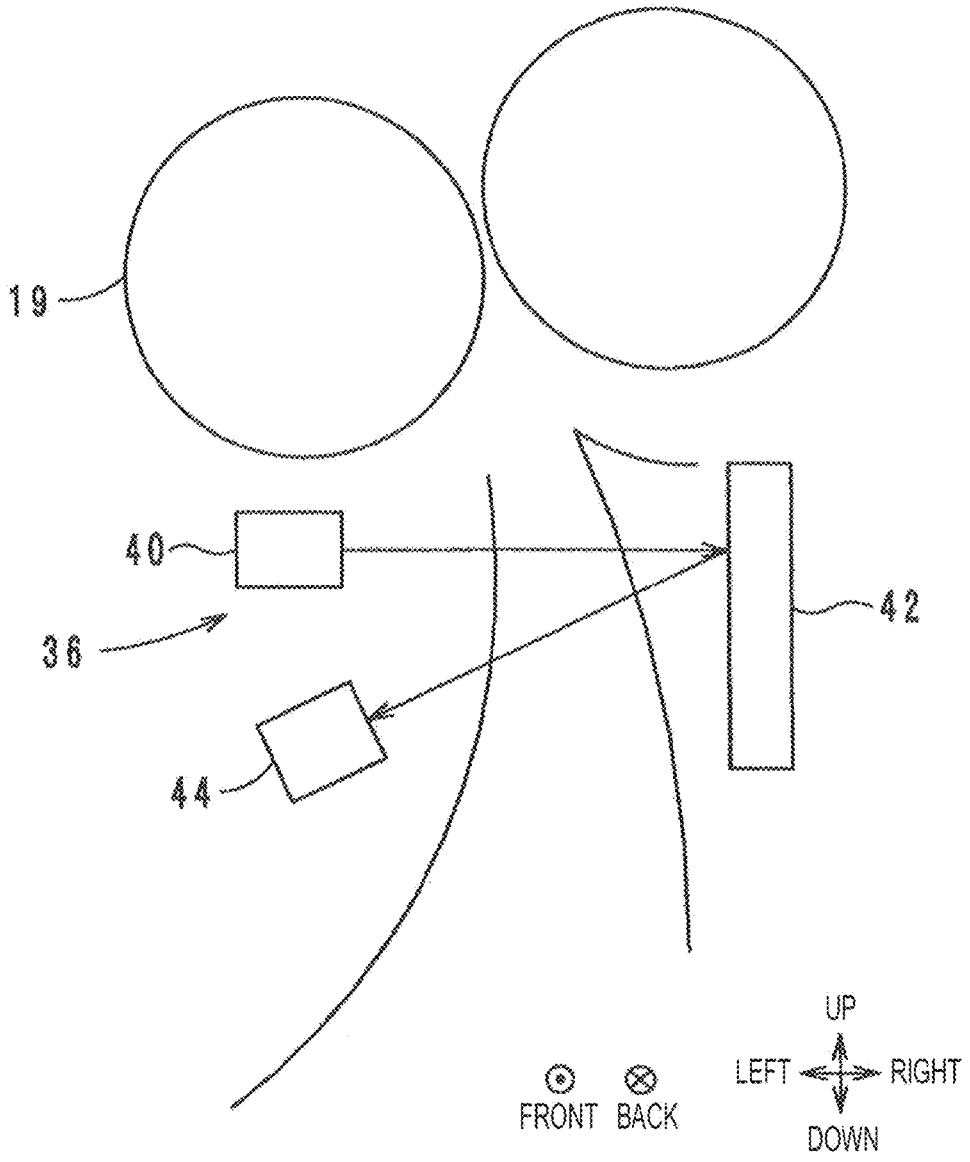
FIG. 2 is a configuration diagram of a whiteness detection unit.

The whiteness detection unit 36 is an information acquisition unit that acquires information related to the whiteness of the paper used for printing and is provided on the upstream side of the timing roller pair 19 in the paper conveyance direction. The whiteness detection unit 36 measures the ISO whiteness of the paper stopped in the timing roller pair 19 by an optical unit. The whiteness detection unit 36 measures the ISO whiteness by, for example, a method according to a Hunter whiteness measurement method. In the Hunter method, the perfect white is defined as 100%, blue-violet light (dominant wavelength is 457 nm) is caused to enter the paper at an incident angle of 45 degrees through a specific blue filter, light reflected in the vertical direction (0 degree) is received, and the reflectance of the reflected light is detected as the ISO whiteness. Hereinafter, a specific configuration of the whiteness detection unit 36 will be described with reference to FIG. 2. FIG. 2 is a configuration diagram of the whiteness detection unit 36.

As shown in FIG. 2, the whiteness detection unit 36 includes a blue LED 40, a reference white board 42, and a photoelectronic sensor 44. The blue LED 40 is provided on the left side of a paper conveyance path and emits light having a peak wavelength of 470 nm in the right direction. The reference white board 42 is provided on the right side of the paper conveyance path and faces the blue LED 40 with the paper conveyance path in between. The light emitted from the blue LED 40 reflects off the surface of the paper or the reference white board 42. The photoelectronic sensor 44 is provided on the left side of the paper conveyance path and faces the reference white board 42 with the paper conveyance path in between. The photoelectronic sensor 44 receives the light reflected off the surface of the paper or the reference white board 42 as incident light, photoelectrically converts the incident light, and outputs a digital signal according to the amount of light to the control unit 30. Hereinafter, the digital signal according to the amount of light is referred to as a whiteness signal. The greater the value of the whiteness signal is, the higher the ISO whiteness is.

Figure 3:
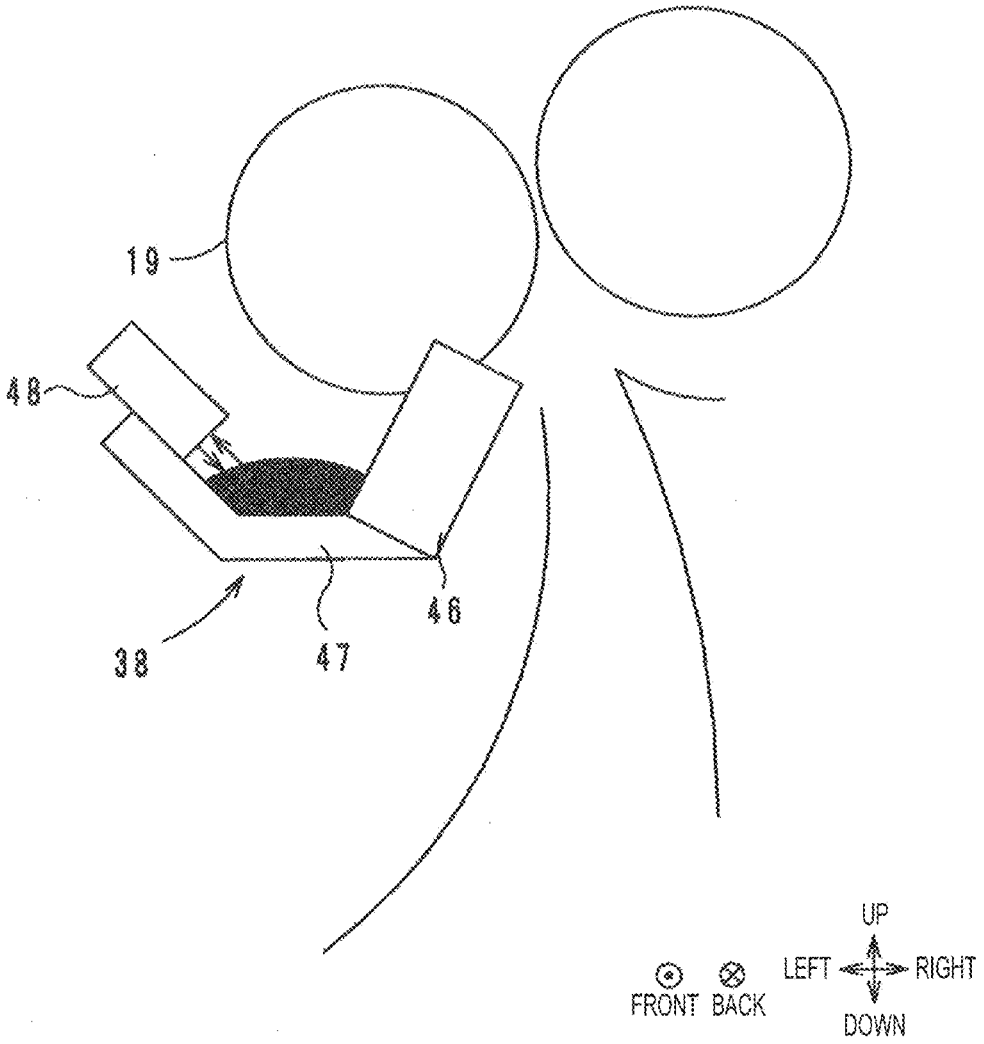
FIG. 3 is a configuration diagram of a paper powder amount detection unit.

The paper powder amount detection unit 38 detects the amount of paper powder generated when the paper passes through a predetermined position in the image forming device 1. In the present embodiment, the paper powder amount detection unit 38 is provided on the upstream side of the timing roller pair 19 in the paper conveyance direction and detects the amount of paper powder generated when the paper passes through the timing roller pair 19. Hereinafter, a configuration example of the paper powder amount detection unit 38 will be described with reference to FIG. 3. FIG. 3 is a configuration diagram of the paper powder amount detection unit 38.

As shown in FIG. 3, the paper powder amount detection unit 38 includes a paper powder removing member 46, a paper powder collection chamber 47, and a paper powder detection sensor 48. The paper powder removing member 46 is in contact with the surface of the left roller of the timing roller pair 19 and scrapes up the paper powder attached to the surface. The paper powder collection chamber 47 houses the scraped paper powder. The paper powder detection sensor 48 detects the amount of paper powder in the paper powder collection chamber 47. Specifically, the paper powder detection sensor 48 detects the distance between the paper powder detection sensor 48 and the paper powder by emitting light to the paper powder and receiving light reflected from the paper powder. The paper powder detection sensor 48 outputs a digital signal according to the distance to the control unit 30. Hereinafter, the digital signal according to the distance is referred to as a paper powder amount signal. The smaller the value of the paper powder amount signal is, the greater the amount of paper powder deposited in the paper powder collection chamber 47 is.

(Identification of Paper)

Figure 4:
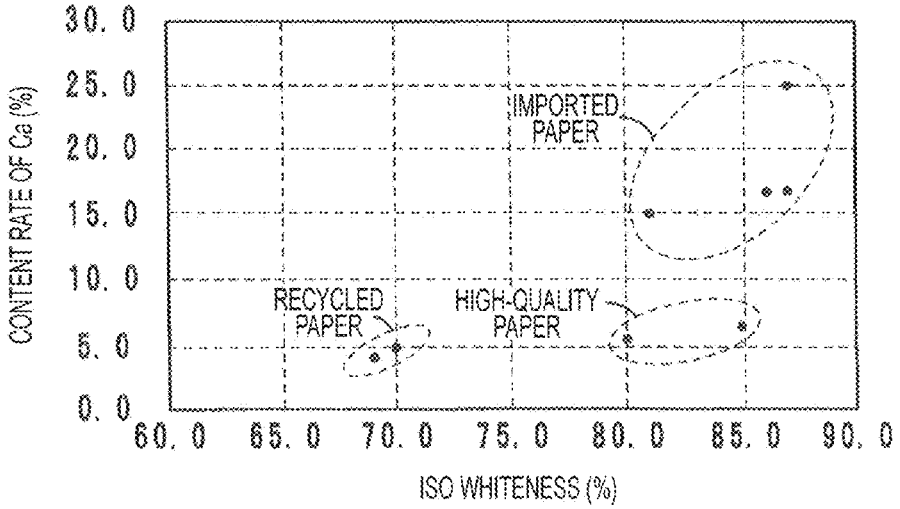
FIG. 4 is a graph showing a relationship between an ISO whiteness of paper and a content rate of Ca in the paper.
Figure 5:
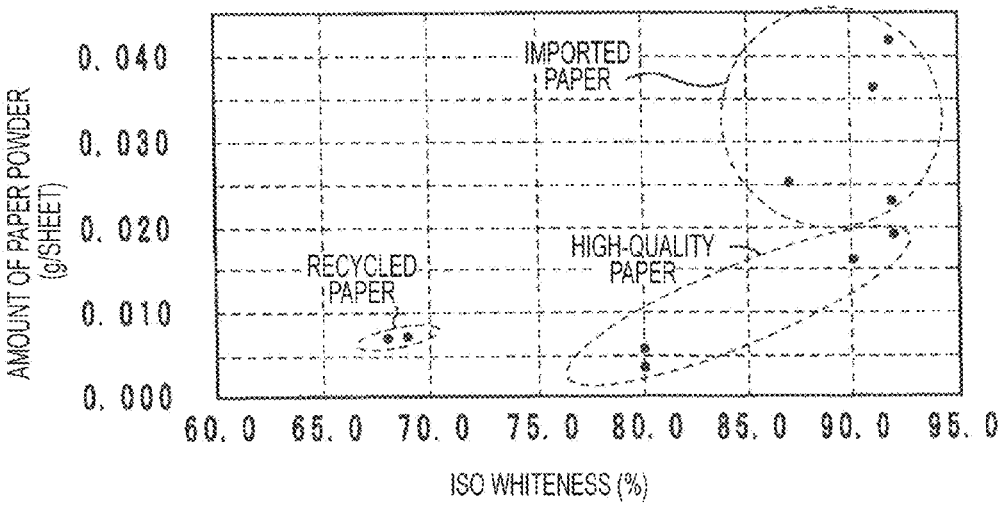
FIG. 5 is a graph showing a relationship between the ISO whiteness of paper and an amount of paper powder of the paper.

First, identification of paper by the image forming device 1 according to the present embodiment will be described with reference to drawings. FIG. 4 is a graph showing a relationship between the ISO whiteness of the paper and a content rate of Ca in the paper. The horizontal axis represents the ISO whiteness and the vertical axis represents the content rate of Ca. The content rate of Ca is a rate of mass of Ca contained in the paper when an elemental analysis of the paper is performed. FIG. 5 is a graph showing a relationship between the ISO whiteness of the paper and the amount of paper powder of the paper. The horizontal axis represents the ISO whiteness and the vertical axis represents the amount of paper powder.

The inventor of the present application studied the relationship between the ISO whiteness of the paper and the content rate of Ca in the paper for the high-quality paper, the recycled paper, and the imported paper. According to FIG. 4, it is known that the content rate of Ca is low in the recycled paper whose ISO whiteness is about 70%. On the other hand, it is known that paper whose ISO whiteness is 80% or more includes paper whose content rate of Ca is low and paper whose content rate of Ca is high. Among sheets of paper whose ISO whiteness is 80% or more, the paper whose content rate of Ca is low is the high-quality paper and the paper whose content rate of Ca is high is the imported paper. In this way, according to FIG. 4, it is possible to determine whether the paper is the recycled paper or either one of the high-quality paper and the imported paper based on the ISO whiteness.

The inventor of the present application studied the relationship between the ISO whiteness of the paper and the amount of paper powder generated from the paper for the high-quality paper, the recycled paper, and the imported paper. According to FIG. 5, it is known that the amount of paper powder generated from the recycled paper and the high-quality paper is relatively small and the amount of paper powder generated from the imported paper is relatively large. In this way, according to FIG. 5, it is possible to determine whether the paper is the imported paper or either one of the high-quality paper and the recycled paper based on the amount of paper powder.

From the above, it is possible to determine whether the paper is the imported paper or the high-quality paper or the recycled paper based on the ISO whiteness and the amount of paper powder. Specifically, paper whose ISO whiteness is low is the recycled paper, paper whose ISO whiteness is high and whose amount of paper powder is small is the high-quality paper, and paper whose ISO whiteness is high and whose amount of paper powder is large is the imported paper.

(Amount of Damage)

Figure 6:
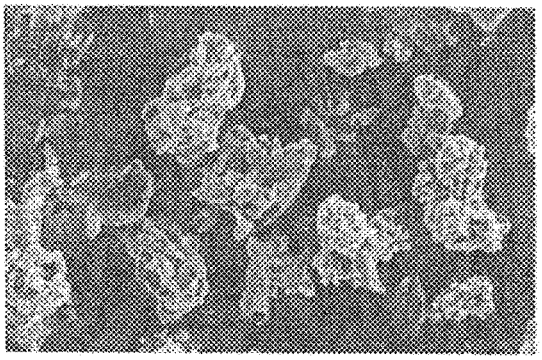
FIG. 6 is an enlarged photograph of imported paper.
Figure 7:
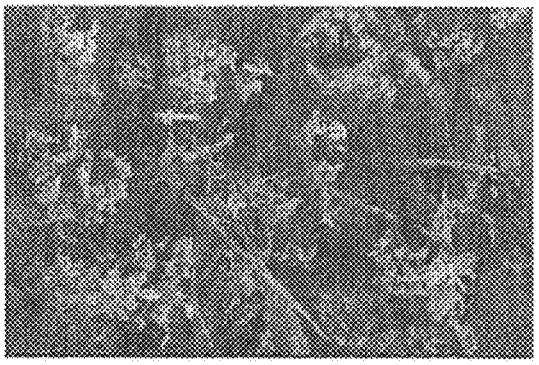
FIG. 7 is an enlarged photograph of recycled paper.

Next, the amount of damage caused by each of the imported paper, the recycled paper, and the high-quality paper, to the consumables will be described with reference to drawings. Examples of the consumables include the intermediate transfer belt 11 and the fixing unit 20 which come into contact with the paper. However, in the description below, the intermediate transfer belt 11 is used as an example of the consumable. FIG. 6 is an enlarged photograph of the imported paper. FIG. 7 is an enlarged photograph of the recycled paper.

As shown in FIG. 6, it is known that the imported paper contains many large particles with sharp points. The particle is white filler formed of calcium carbonate and there is a risk that the particle causes relatively large damage to the intermediate transfer belt 11. On the other hand, it is known that the recycled paper has a fibrous shape. Such fibers are cellulose and cause relatively small damage to the intermediate transfer belt 11.

Figure 8:
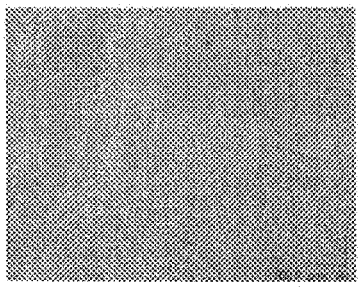
FIG. 8 is a photograph of an intermediate transfer belt before printing.
Figure 9:
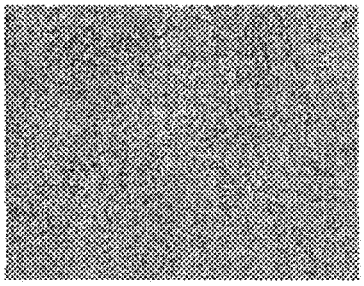
FIG. 9 is a photograph of the intermediate transfer belt after printing 150,000 sheets of imported paper.
Figure 10:
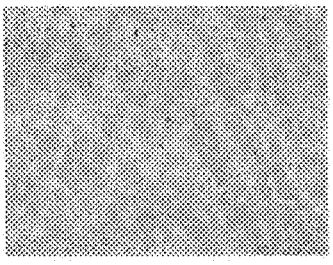
FIG. 10 is a photograph of the intermediate transfer belt after printing 150,000 sheets of recycled paper.

Therefore, the inventor of the present application printed 150,000 sheets of imported paper and 150,000 sheets of recycled paper and studied damage caused to the intermediate transfer belt 11. FIG. 8 is a photograph of the intermediate transfer belt 11 before the printing. FIG. 9 is a photograph of the intermediate transfer belt 11 after printing 150,000 sheets of imported paper. FIG. 10 is a photograph of the intermediate transfer belt 11 after printing 150,000 sheets of recycled paper. In FIGS. 8 to 10, a black portion represents a portion which is damaged and dented in the intermediate transfer belt 11.

According to FIG. 8, the intermediate transfer belt 11 has almost no damage before the printing. According to FIG. 9, it is known that the intermediate transfer belt 11 has a relatively large number of scars. On the other hand, according to FIG. 10, it is known that the intermediate transfer belt 11 has a relatively small number of scars. Therefore, it is known that the imported paper containing a large amount of calcium carbonate causes a relatively large amount of damage to the intermediate transfer belt 11 and the recycled paper containing a large amount of cellulose causes a relatively small amount of damage to the intermediate transfer belt 11. The high-quality paper does not contain a large amount of calcium carbonate, so that the high-quality paper causes a relatively small amount of damage to the intermediate transfer belt 11.

It is possible to define the amount of damage as shown in a first table shown in Table 1 based on FIGS. 4 to 10. The amount of damage in Table 1 is a dimensionless value and represents the magnitude of damage caused by a sheet of paper to the intermediate transfer belt 11 when the sheet of paper passes through the intermediate transfer belt 11. The greater the value of the amount of damage, the greater the amount of damage.

TABLE 1

| | | ISO whiteness | |
|---|---|---|---|
| | | Less than 75% | 75% or more |
| Amount of paper powder | 0.020 g/sheet or more | 0.7 | 1 |
| | Less than 0.020 g/sheet | 0.7 | 0.8 |

(Block Diagram of Damage Amount Determination Device)

Figure 11:
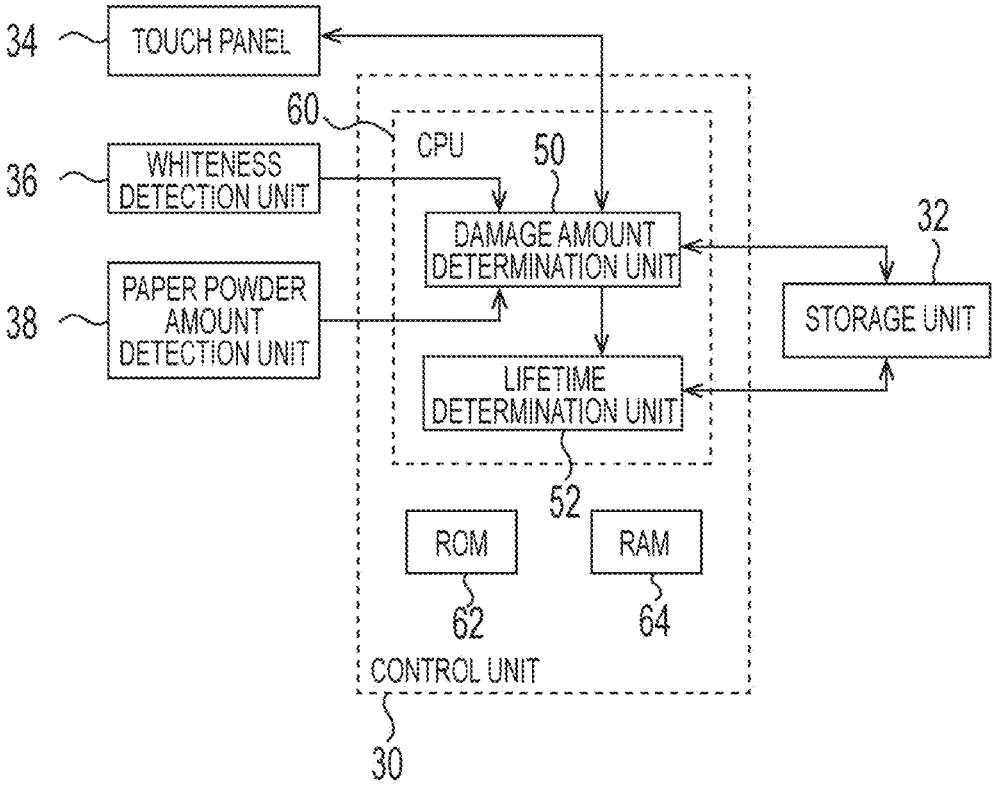
FIG. 11 is a block diagram of a damage amount determination device.

Next, a block diagram of the damage amount determination device included in the image forming device 1 will be described with reference to FIG. 11. FIG. 11 is the block diagram of the damage amount determination device.

The damage amount determination device includes the control unit 30, the storage unit 32, the touch panel 34, the whiteness detection unit 36, and the paper powder amount detection unit 38. The control unit 30 includes a CPU 60, a ROM 62, and a RAM 64. The CPU 60 includes a damage amount determination unit 50 and a lifetime determination unit 52.

The storage unit 32 stores the first table shown in Table 1. The storage unit 32 further stores a second table in which amounts of damage D1 and D2 are set for the paper feed cassettes 15*a* and 15*b* respectively. Table 2 is the second table.

TABLE 2

| | Amount of damage |
|---|---|
| D1 | 1 |
| D2 | 0.7 |

The ROM 62 stores data such as a damage amount determination program described later. The RAM 64 is a temporary storage area used when the CPU 60 performs processing.

The damage amount determination unit 50 determines the amount of damage caused by paper to the intermediate transfer belt 11 by using the first table of Table 1 on the basis of a whiteness signal outputted from the whiteness detection unit 36 and a paper powder amount signal outputted from the paper powder amount detection unit 38. Further, when the paper is a sheet of paper supplied from the paper feed cassette 15*a*, the damage amount determination unit 50 sets the amount of damage D1 in the second table of Table 2 to the determined amount of damage. On the other hand, when the paper is a sheet of paper supplied from the paper feed cassette 15*b*, the damage amount determination unit 50 sets the amount of damage D2 in the second table of Table 2 to the determined amount of damage. In other words, the damage amount determination unit 50 determines the amount of damage for each of the paper feed cassettes 15*a* and 15*b*.

The storage unit 32 stores a lifetime of the intermediate transfer belt 11 as an amount of life L. The amount of life L is a parameter of the same dimension as that of the amount of damage and is a total sum of the amounts of damage allowed for the intermediate transfer belt 11. A predetermined amount of life L is set for a brand new intermediate transfer belt 11.

The lifetime determination unit 52 determines the lifetime of the intermediate transfer belt 11 based on the amount of damage determined by the damage amount determination unit 50. Specifically, the lifetime determination unit 52 subtracts the amount of damage from the amount of life L each time a sheet of paper is printed. In the present embodiment, the lifetime determination unit 52 subtracts the amount of damage D1 from the amount of life L when a sheet of paper of the paper feed cassette 15*a* is printed and subtracts the amount of damage D2 from the amount of life L when a sheet of paper of the paper feed cassette 15*b* is printed. When the amount of life L becomes 0 or less, the lifetime determination unit 52 determines that the lifetime of the intermediate transfer belt 11 is ended and causes the touch panel 34 to display a message accordingly.

(Operation of Image Forming Device)

Figure 12:
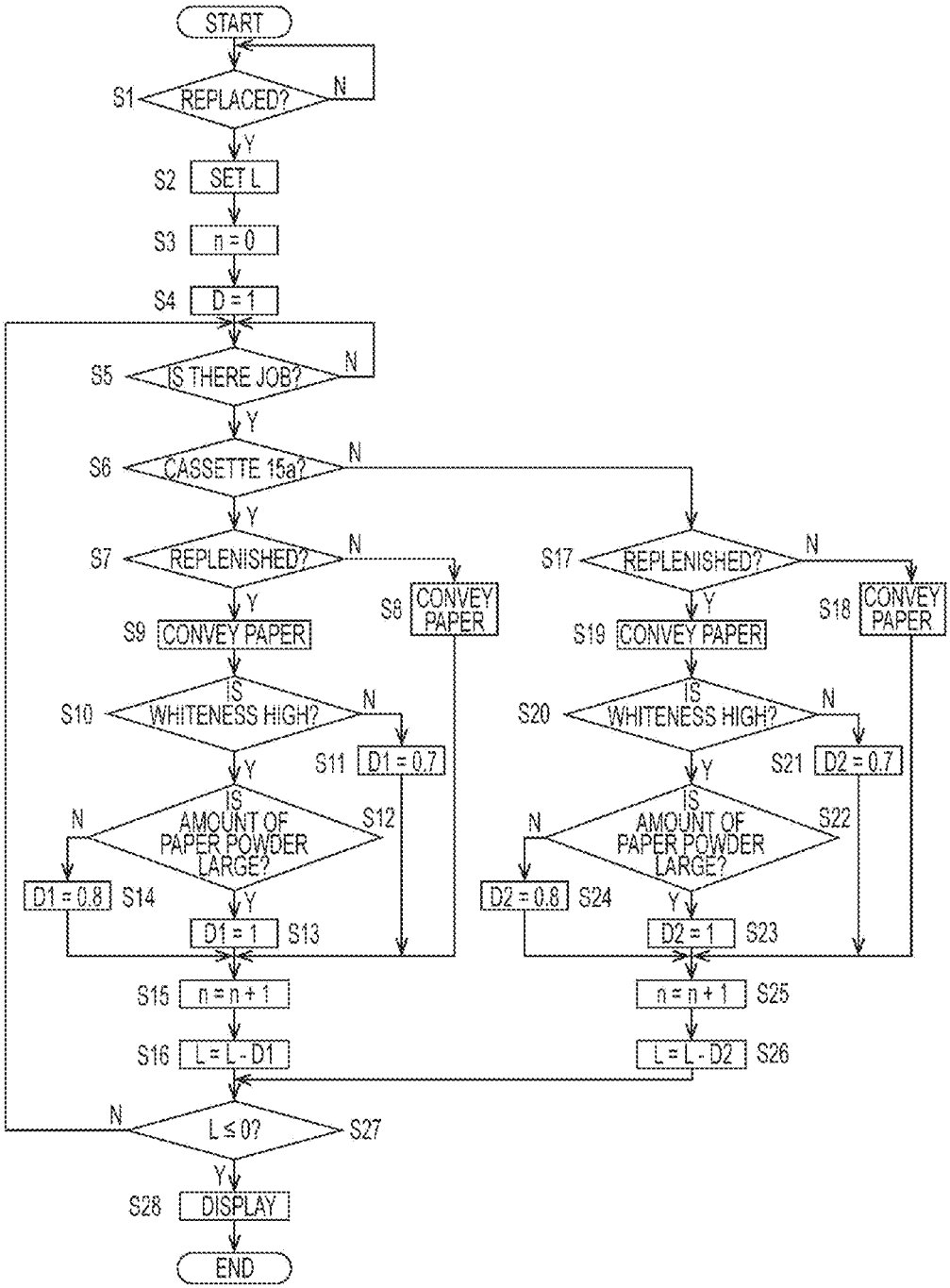
FIG. 12 is a diagram showing a flowchart executed by a control unit of the image forming device.

Hereinafter, an operation performed by the image forming device 1 to determine the amount of damage will be described with reference to FIG. 12. FIG. 12 is a diagram showing a flowchart executed by the control unit 30 of the image forming device 1. The damage amount determination is performed when the CPU 60 of the control unit 30 reads the damage amount determination program stored in the ROM 62 to store the damage amount determination program in the RAM 64 and executes the damage amount determination program. However, the damage amount determination may be performed by hardware.

First, the control unit determines whether or not the intermediate transfer belt 11 is replaced (step S1). When the intermediate transfer belt 11 is replaced, the process proceeds to step S2. On the other hand, when the intermediate transfer belt 11 is not replaced, the process returns to step S1. In this case, step S1 is repeated until the intermediate transfer belt 11 is replaced.

When the intermediate transfer belt 11 is replaced, the lifetime determination unit 52 sets the amount of life L of the intermediate transfer belt 11 stored in the storage unit 32 to an initial value (step S2). Further, the damage amount determination unit 50 sets the number of printed sheets of paper n to 0 (step S3) and sets the amounts of damage D1 and D2 in the second table of Table 2 to 1 (step S4). In steps S2 to S4, the control unit 30 performs initialization. The number of printed sheets of paper n indicates how many sheets of paper have been printed since the intermediate transfer belt 11 was replaced. Thereafter, the process proceeds to step S5.

The control unit 30 determines whether or not a print job is inputted (step S5). When a print job is inputted, the process proceeds to step S6. When a print job is not inputted, the process returns to step S5. In this case, step S5 is repeated until a print job is inputted.

When a print job is inputted, the damage amount determination unit 50 determines whether or not paper used for printing is stored in the cassette 15*a* (step S6). When the paper used for printing is stored in the cassette 15*a*, the process proceeds to step S7. On the other hand, when the paper used for printing is not stored in the cassette 15*a*, it is assumed that the paper used for printing is stored in the cassette 15*b* and the process proceeds to step S17.

When the paper used for printing is stored in the cassette 15*a*, the damage amount determination unit 50 determines whether or not the paper is replenished to the paper feed cassette 15*a* after the previous print job is performed (step S7). When the paper is replenished to the paper feed cassette 15*a*, it is possible that the type of the paper is changed and the amount of damage D1 is changed. In other words, in step S7, the damage amount determination unit 50 determines whether or not there is a probability that the amount of damage D1 is changed. When the paper is not replenished, the process proceeds to step S8. When the paper is replenished, the process proceeds to step S9.

When the paper is not replenished, the control unit 30 starts conveyance of a sheet of paper from the paper feed cassette 15*a* (step S8). Thereafter, the process proceeds to step S15 without determining the amount of damage.

When the paper is replenished, the control unit 30 starts conveyance of a sheet of paper from the paper feed cassette 15*a* (step S9). While the paper is being conveyed, the whiteness detection unit 36 detects the ISO whiteness of the paper and outputs the whiteness signal to the damage amount determination unit 50 and the paper powder amount detection unit 38 detects the amount of paper powder and outputs the paper powder amount signal to the damage amount determination unit 50. The paper powder amount detection unit 38 outputs the paper powder amount signal for each passage of the paper. Therefore, the damage amount determination unit 50 can calculates the amount of paper powder per sheet of paper by calculating a difference between the previous paper powder amount signal and the current paper powder amount signal. The calculation of the amount of paper powder per sheet of paper is as described in Japanese Patent Application No. 2013-261308, so that detailed description will be omitted.

Subsequently, the damage amount determination unit 50 determines whether or not the ISO whiteness is 75% or more based on the first table of Table 1 and the whiteness signal (step S10). When the ISO whiteness is less than 75%, the process proceeds to step S11. When the ISO whiteness is 75% or more, the process proceeds to step S12.

When the ISO whiteness is less than 75%, the damage amount determination unit 50 determines that the paper is the recycled paper that causes a small amount of damage. Then, the damage amount determination unit 50 sets the amount of damage D1 in the second table of Table 2 to 0.7 based on the first table of Table 1 (step S11). Thereafter, the process proceeds to step S15.

When the ISO whiteness is 75% or more, the damage amount determination unit 50 determines that the paper is the high-quality paper or the imported paper. Then, the damage amount determination unit 50 determines whether or not the amount of paper powder is 0.020 g/sheet or more based on the first table of Table 1 and the paper powder amount signal (step S12). When the amount of paper powder is 0.020 g/sheet or more, the process proceeds to step S13. When the amount of paper powder is less than 0.020 g/sheet, the process proceeds to step S14.

When the amount of paper powder is 0.020 g/sheet or more, the damage amount determination unit 50 determines that the paper is the imported paper that causes a large amount of damage. Then, the damage amount determination unit 50 sets the amount of damage D1 in the second table of Table 2 to 1 based on the first table of Table 1 (step S13). Thereafter, the process proceeds to step S15.

When the amount of paper powder is less than 0.020 g/sheet, the damage amount determination unit 50 determines that the paper is the high-quality paper that causes a small amount of damage. Then, the damage amount determination unit 50 sets the amount of damage D1 in the second table of Table 2 to 0.8 based on the first table of Table 1 (step S14). Thereafter, the process proceeds to step S15.

In step S15 described above, the damage amount determination unit 50 increments the number of printed sheets of paper n by 1 (step S15). Further, the lifetime determination unit 52 subtracts the amount of damage D1 from the amount of life L (step S16). Thereafter, the process proceeds to step S27.

In step S6 described above, when the paper used for printing is not stored in the cassette 15*a*, the damage amount determination unit 50 determines whether or not the paper is replenished to the paper feed cassette 15*b* after the previous print job is performed (step S17). When the paper is replenished to the paper feed cassette 15*b*, it is possible that the type of the paper is changed and the amount of damage D2 is changed. In other words, in step S17, the damage amount determination unit 50 determines whether or not there is a probability that the amount of damage D2 is changed. When the paper is not replenished, the process proceeds to step S18. When the paper is replenished, the process proceeds to step S19.

When the paper is not replenished, the control unit 30 starts conveyance of a sheet of paper from the paper feed cassette 15*b* (step S18). Thereafter, the process proceeds to step S25 without determining the amount of damage.

When the paper is replenished, the control unit 30 starts conveyance of a sheet of paper from the paper feed cassette 15*b* (step S19). Subsequently, the damage amount determination unit 50 determines whether or not the ISO whiteness is 75% or more based on the first table of Table 1 and the whiteness signal (step S20). When the ISO whiteness is less than 75%, the process proceeds to step S21. When the ISO whiteness is 75% or more, the process proceeds to step S22.

When the ISO whiteness is less than 75%, the damage amount determination unit 50 determines that the paper is the recycled paper that causes a small amount of damage. Then, the damage amount determination unit 50 sets the amount of damage D2 in the second table of Table 2 to 0.7 based on the first table of Table 1 (step S21). Thereafter, the process proceeds to step S25.

When the ISO whiteness is 75% or more, the damage amount determination unit 50 determines that the paper is the high-quality paper or the imported paper. Then, the damage amount determination unit 50 determines whether or not the amount of paper powder is 0.020 g/sheet or more based on the first table of Table 1 and the paper powder amount signal (step S22). When the amount of paper powder is 0.020 g/sheet or more, the process proceeds to step S23. When the amount of paper powder is less than 0.020 g/sheet, the process proceeds to step S24.

When the amount of paper powder is 0.020 g/sheet or more, the damage amount determination unit 50 determines that the paper is the imported paper that causes a large amount of damage. Then, the damage amount determination unit 50 sets the amount of damage D2 in the second table of Table 2 to 1 based on the first table of Table 1 (step S23). Thereafter, the process proceeds to step S25.

When the amount of paper powder is less than 0.020 g/sheet, the damage amount determination unit 50 determines that the paper is the high-quality paper that causes a small amount of damage. Then, the damage amount determination unit 50 sets the amount of damage D2 in the second table of Table 2 to 0.8 based on the first table of Table 1 (step S24). Thereafter, the process proceeds to step S25.

In step S25 described above, the damage amount determination unit 50 increments the number of printed sheets of paper n by 1 (step S25). Further, the lifetime determination unit 52 subtracts the amount of damage D2 from the amount of life L (step S26). Thereafter, the process proceeds to step S27.

In step S27 described above, the lifetime determination unit 52 determines whether or not the amount of life L is 0 or less (step S27). When the amount of life L is 0 or less, the process proceeds to step S28. When the amount of life L is more than 0, the process returns to step S5. In this case, the process of steps S5 to S27 is repeated until the amount of life L becomes 0 or less.

When L is 0 or less, the lifetime determination unit 52 determines that the lifetime of the intermediate transfer belt 11 is ended and causes the touch panel 34 to display a message accordingly (step S28). Thereafter, the process ends.

(Effects)

According to the damage amount determination device of the present embodiment, it is possible to determine the amount of damage caused by the paper to the intermediate transfer belt 11 of the image forming device 1. More specifically, the amount of damage caused by the recycled paper whose ISO whiteness is relatively low to the intermediate transfer belt 11 is relatively small. The amount of damage caused by the high-quality paper whose ISO whiteness is relatively high to the intermediate transfer belt 11 is relatively small. The amount of damage caused by the imported paper whose ISO whiteness is relatively large to the intermediate transfer belt 11 is relatively large. In other words, when the ISO whiteness is relatively low, the damage caused by the paper to the intermediate transfer belt 11 is relatively small. On the other hand, when the ISO whiteness is relatively high, the damage caused by the paper to the intermediate transfer belt 11 is relatively small or relatively large. Therefore, when the damage amount determination device determines that the ISO whiteness of the paper is relatively low, the damage amount determination device can determine that the amount of damage caused by the paper to the intermediate transfer belt 11 is small. Thereby, the damage amount determination unit 50 can set the amount of damage according to the type of the paper.

According to the damage amount determination device, it is possible to determine the amount of damage caused by the paper to the intermediate transfer belt 11 of the image forming device 1 for the reason described below. More specifically, the amount of damage caused by the high-quality paper to the intermediate transfer belt 11 is relatively small and the amount of damage caused by the imported paper to the intermediate transfer belt 11 is relatively large. However, the ISO whiteness of both the high-quality paper and the imported paper is relatively high. Therefore, the damage amount determination unit 50 determines whether the paper to be printed is the high-quality paper or the imported paper based on the paper powder amount signal. Thereby, the damage amount determination unit 50 can more accurately set the amount of damage according to the type of the paper.

According to the damage amount determination device, it is possible to accurately manage the lifetime of the intermediate transfer belt 11. More specifically, a conventional image forming device manages the lifetimes of consumables by the number of printed sheets of paper and does not manage the lifetimes of consumables by considering the types of printed sheets of paper. Therefore, the lifetimes of the consumables are set based on paper that causes a relatively large amount of damage. Thus, when many sheets of paper that causes a relatively small amount of damage, such as the high-quality paper and the recycled paper, are printed, there is a risk that the image forming device determines that a lifetime of a consumable is ended and prompts to replace the consumable even though the lifetime of the consumable is not actually ended.

On the other hand, according to the damage amount determination device, the damage amount determination unit 50 sets the amount of damage according to the type of the paper. The lifetime determination unit 52 subtracts the amount of damage from the amount of life L of the intermediate transfer belt 11 each time a sheet of paper is printed. Thereby, the lifetime determination unit 52 can accurately manage the amount of life L of the intermediate transfer belt 11. As a result, according to the damage amount determination device, the lifetime determination unit 52 is prevented from determining that the lifetime of the intermediate transfer belt 11 is ended even though the lifetime of the intermediate transfer belt 11 is not actually ended. Therefore, according to the damage amount determination device, it is possible to practically extend the lifetime of the intermediate transfer belt 11.

According to the damage amount determination device, it is possible to determine the amount of damage caused by the paper to the intermediate transfer belt 11 of the image forming device 1 in a short time. More specifically, the amount of damage caused by the recycled paper to the intermediate transfer belt 11 is relatively small and the amount of damage caused by the imported paper to the intermediate transfer belt 11 is relatively large. Therefore, the damage amount determination unit 50 determines whether the paper to be printed is the recycled paper or the imported paper based on the whiteness signal. Thereby, the damage amount determination unit 50 can set the amount of damage according to the type of the paper in a short time because the time to cause the paper powder to be deposited is not required.

According to the damage amount determination device, the damage amount determination unit 50 is prevented from performing useless damage amount determination processing. More specifically, when the paper feed cassettes 15*a* and 15*b* are replenished with paper, the amounts of damage D1 and D2 change, respectively. Therefore, in the present embodiment, the damage amount determination unit 50 determines the amount of damage according to the replenishment of the paper feed cassettes 15*a* and 15*b* with paper. Specifically, when the paper feed cassettes 15*a* and/or 15*b* are replenished with paper, the damage amount determination unit 50 determines the amount of damage, and when the paper feed cassettes 15*a* and 15*b* are not replenished with paper, the damage amount determination unit 50 does not determine the amount of damage. Thereby, the damage amount determination unit 50 is prevented from performing useless damage amount determination processing.

Modified Example

Hereinafter, a damage amount determination device according to a modified example and an image forming device 1 including the damage amount determination device will be described with reference to drawings. The configurations of the damage amount determination device and the image forming device 1 according to the modified example are the same as those of the damage amount determination device and the image forming device 1 according to the embodiment described above, so that FIGS. 1 to 3 and 11 are referred to again.

The difference between the damage amount determination device and the image forming device 1 according to the modified example and the damage amount determination device and the image forming device 1 according to the embodiment described above is presence or absence of determination processing of the amount of paper powder. In other words, the damage amount determination device and the image forming device 1 according to the modified example determine the amount of damage based on only the ISO whiteness. Therefore, the storage unit 32 stores a third table shown in Table 3. In the third table, when the ISO whiteness of the paper is lower than a predetermined value (75%), the amount of damage caused by the paper to the intermediate transfer belt 11 is relatively small and, when the ISO whiteness of the paper is higher than or equal to the predetermined value (75%), the amount of damage caused by the paper to the intermediate transfer belt 11 is relatively large.

TABLE 3

| | ISO whiteness | |
|---|---|---|
| | Less than 75% | 75% or more |
| Amount of damage | 0.7 | 1 |

Figure 13:
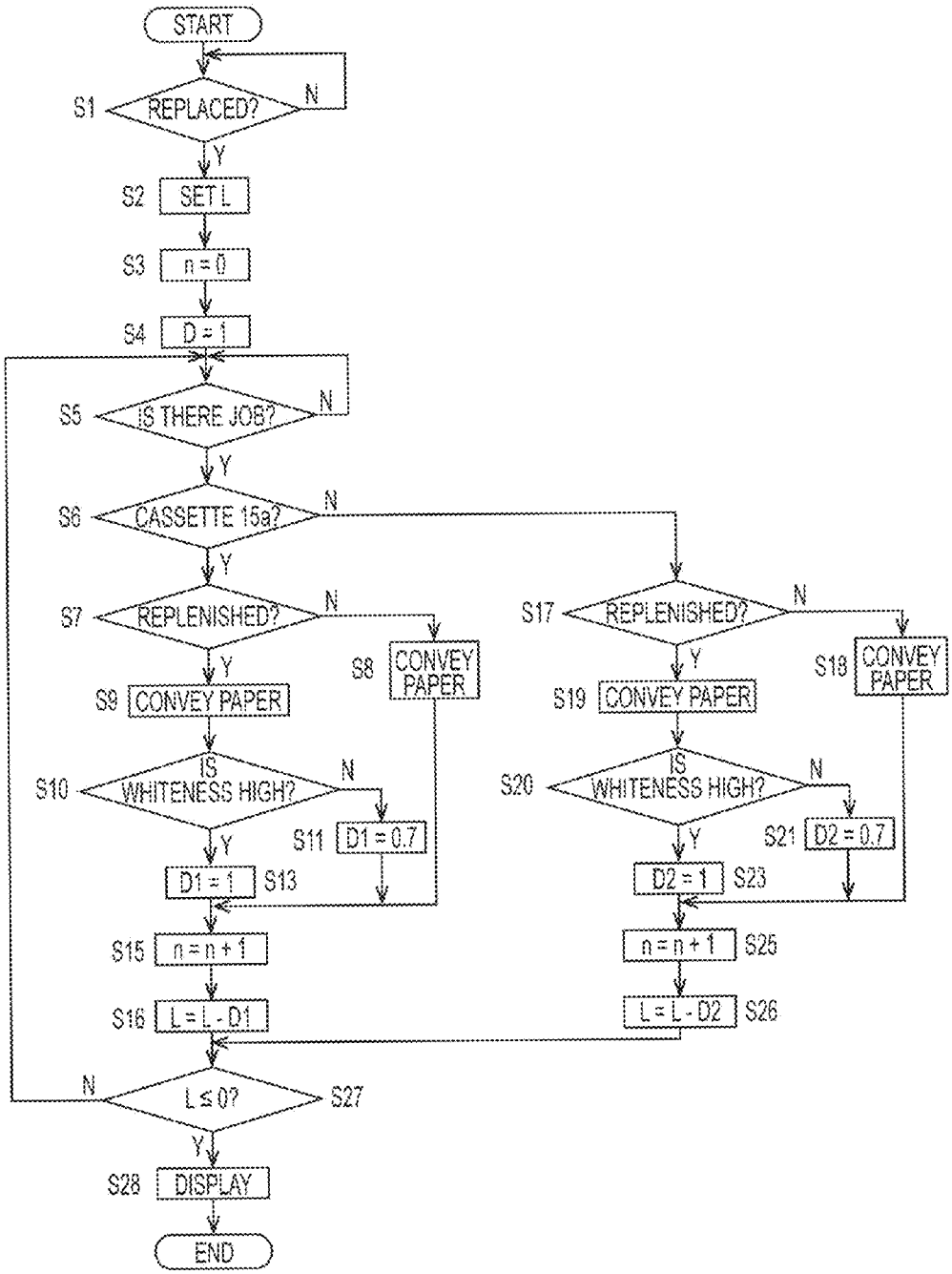
FIG. 13 is a diagram showing a flowchart executed by the control unit of the image forming device.

Next, an operation performed by the image forming device 1 to determine the amount of damage will be described with reference to FIG. 13. FIG. 13 is a diagram showing a flowchart executed by the control unit 30 of the image forming device 1. In FIG. 13, the same processes as those in FIG. 12 are denoted by the same step numbers.

The flowchart in FIG. 13 is different from that in FIG. 12 in that there are not steps 12 and 14. The other steps in the flowchart in FIG. 13 are the same as those in the flowchart in FIG. 12, so that the description will be omitted.

According to the damage amount determination device of the modified example configured as described above, it is possible to determine the amount of damage caused by the paper to the intermediate transfer belt 11 of the image forming device 1 in the same manner as the damage amount determination device of the embodiment described above.

According to the damage amount determination device of the modified example, it is possible to accurately manage the lifetime of the intermediate transfer belt 11 in the same manner as the damage amount determination device of the embodiment described above. More specifically, the amount of damage caused by the recycled paper whose ISO whiteness is relatively low to the intermediate transfer belt 11 is relatively small. The amount of damage caused by the high-quality paper whose ISO whiteness is relatively high to the intermediate transfer belt 11 is relatively small. The amount of damage caused by the imported paper whose ISO whiteness is relatively large to the intermediate transfer belt 11 is relatively large. In other words, when the ISO whiteness is relatively low, the damage caused by the paper to the intermediate transfer belt 11 is relatively small. On the other hand, when the ISO whiteness is relatively high, the damage caused by the paper to the intermediate transfer belt 11 is relatively small or relatively large.

Therefore, the damage amount determination device assumes that when the ISO whiteness is relatively low, the amount of damage caused by the paper to the intermediate transfer belt 11 is relatively small and, when the ISO whiteness is relatively high, the amount of damage caused by the paper to the intermediate transfer belt 11 is relatively large. Thereby, when the high-quality paper whose chromaticity is high is printed, the amount of damage that is larger than the actual amount of damage is subtracted from the amount of life L. However, when the recycled paper whose ISO whiteness is low is printed, the actual amount of damage is subtracted from the amount of life L, and when the imported paper whose ISO whiteness is high is printed, the actual amount of damage is subtracted from the amount of life L. In other words, when the paper whose ISO whiteness is low is printed, a correct amount of damage is subtracted from the amount of life L. On the other hand, when the paper whose ISO whiteness is high is printed, a correct amount of damage or the amount of damage larger than a correct amount of damage is subtracted from the amount of life L. Therefore, while a conventional image forming device sets a uniformly large amount of damage for all types of paper, the damage amount determination device according to the modified example can set a correct small amount of damage for at least some type of paper. Therefore, according to the damage amount determination device, it is possible to more accurately manage the amount of life L of the intermediate transfer belt 11 than the conventional image forming device. As a result, according to the damage amount determination device, the damage amount determination device is prevented from determining that the lifetime of the intermediate transfer belt 11 is ended even though the lifetime of the intermediate transfer belt 11 is not actually ended. Therefore, according to the damage amount determination device, it is possible to practically extend the lifetime of the intermediate transfer belt 11.

Other Embodiments

The damage amount determination device according to the present invention is not limited to the damage amount determination devices according to the embodiment and the modified example, but can be variously modified without departing from the scope of the invention.

Although the ISO whiteness is used as the information related to the whiteness in the damage amount determination device, the information related to the whiteness may be, for example, the type of paper. In this case, the storage unit 32 stores a relationship between the type of paper and the amount of damage. When a user specifies a print job, the user inputs the type of paper by using the touch panel 34. The damage amount determination unit 50 determines the amount of damage based on information of the type of paper acquired from the input of the user and the relationship between the type of paper and the amount of damage stored in the storage unit 32.

In the damage amount determination device, the damage amount determination unit 50 acquires the ISO whiteness from the whiteness detection unit 36. However, the damage amount determination unit 50 may acquire the ISO whiteness based on an input of the user through the touch panel 34.

For the damage amount determination device, the consumables are not limited to the intermediate transfer belt 11, but may be any consumables with which the paper comes into contact. An example of the consumables with which the paper comes into contact is the fixing unit 20. The consumable may be a photoreceptor in an image forming device in which a toner image is directly transferred from the photoreceptor to the paper.

In the damage amount determination device, as shown in Table 1, two levels of the ISO whiteness are determined, and two levels of the amount of paper powder are determined. However, three or more levels of the ISO whiteness may be determined, and three or more levels of the amount of paper powder may be determined. Table 4 is a first table in a case in which three levels of the ISO whiteness are determined and three levels of the amount of paper powder are determined.

TABLE 4

| | | ISO whiteness | | |
|---|---|---|---|---|
| | | Less than 75% | 75% or more and less than 85% | 85% or more |
| Amount of paper powder | Small | 0.7 | 0.7 | 0.8 |
| | Intermediate | 0.7 | 0.8 | 0.9 |
| | Large | 0.7 | 0.9 | 1 |

Although the damage amount determination device determines the amount of paper powder every time a sheet of paper is conveyed, the damage amount determination device may determine the amount of paper powder each time a predetermined number of sheets of paper are conveyed.

Although the damage amount determination device subtracts the amount of damage D1 or D2 from the amount of life L every time a sheet of paper is conveyed, the damage amount determination device may collectively subtracts the amounts of damage D1 or D2 from the amount of life L each time a predetermined number of sheets of paper are conveyed.

The damage amount determination device, the image forming device, the damage amount determination program, and the damage amount determination method according to the present invention have an advantage to be able to determine the amount of damage caused by paper to a predetermined component of the image forming device.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A damage amount determination device used for an image forming device that forms an image on paper, the damage amount determination device comprising:

an information acquisition unit that acquires information related to whiteness of the paper used for printing; and a damage amount determination unit that determines an amount of damage, which is caused by the paper to a predetermined component of the image forming device when the paper passes through the predetermined component, based on the information related to the whiteness, wherein the information related to the whiteness is the whiteness of the paper, and the damage amount determination unit determines that when the whiteness of the paper is lower than a predetermined value, the amount of damage caused by the paper to the predetermined component is relatively small and, when the whiteness of the paper is higher than or equal to the predetermined value, the amount of damage caused by the paper to the predetermined component is relatively large.

2. The damage amount determination unit according to claim 1, further comprising:

a lifetime determination unit that determines a lifetime of the predetermined component based on the amount of damage determined by the damage amount determination unit.

3. The damage amount determination unit according to claim 2, wherein the lifetime determination unit subtracts the amount of damage from an amount of life that is a total sum of the amounts of damage allowed by the predetermined component each time the paper is printed.

4. The damage amount determination unit according claim 1, wherein the information acquisition unit acquires the information related to the whiteness based on an input of a user.

5. The damage amount determination unit according claim 1, wherein the information related to the whiteness is a type of the paper, the damage amount determination device further includes a storage unit that stores a relationship between the type of the paper and the amount of damage, and the damage amount determination unit determines the amount of damage by using the relationship between the type of the paper and the amount of damage.

6. The damage amount determination unit according claim 1, wherein the information acquisition unit acquires the information related to the whiteness by an optical unit.

7. The damage amount determination unit according to claim 6, wherein the information acquisition unit is provided on an upstream side of a timing roller of the image forming device in a conveyance direction of the paper and acquires the information related to the whiteness of the paper stopped at the timing roller by the optical unit.

8. The damage amount determination unit according claim 4, wherein the information related to the whiteness is an ISO whiteness of the paper.

9. The damage amount determination unit according claim 1, further comprising:

a paper powder amount detection unit that detects an amount of paper powder generated when the paper passes through a predetermined position in the image forming device, wherein the damage amount determination unit determines the amount of damage, which is caused by the paper to the predetermined component, based on the information related to the whiteness and the amount of paper powder.

10. The damage amount determination unit according claim 1, wherein the damage amount determination unit determines the amount of damage for each of a plurality of paper feed cassettes of the image forming device.

11. The damage amount determination unit according claim 1, wherein the damage amount determination unit determines the amount of damage according to replenishment of a plurality of paper feed cassettes of the image forming device with the paper.

12. The damage amount determination unit according claim 1, wherein the predetermined component is an intermediate transfer belt, a fixing unit, or a photoreceptor, with which the paper comes into contact, of the image forming device.

13. An image forming device comprising:

the damage amount determination unit according to claim 1.

14. A non-transitory recording medium storing a computer readable program which determines a damage amount and is executed in a damage amount determination device used for an image forming device that forms an image on paper, the program causing the damage amount determination device to execute:

a step of acquiring information related to whiteness of the paper used for printing; and a step of determining an amount of damage, which is caused by the paper to a predetermined component of the image forming device when the paper passes through the predetermined component, based on the information related to the whiteness, wherein the information related to the whiteness is the whiteness of the paper, and the step of determining the amount of damage includes determining that when the whiteness of the paper is lower than a predetermined value, the amount of damage caused by the paper to the predetermined component is relatively small and, when the whiteness of the paper is higher than or equal to the predetermined value, the amount of damage caused by the paper to the predetermined component is relatively large.

15. The non-transitory recording medium according to claim 14, wherein the computer readable program further includes a lifetime determination step of determining a lifetime of the predetermined component based on the amount of damage determined in the step of determining the amount of damage.

16. The non-transitory recording medium according to claim 14, wherein the computer readable program further includes a paper powder amount detection step of detecting an amount of paper powder generated when the paper passes through a predetermined position in the image forming device, and in the step of determining the amount of damage, the amount of damage caused by the paper to the predetermined component is determined based on the information related to the whiteness and the amount of paper powder.

17. A damage amount determination method performed in an image forming device that forms an image on paper, the damage amount determination method comprising:

a step of acquiring information related to whiteness of the paper used for printing; and a step of determining an amount of damage, which is caused by the paper to a predetermined component of the image forming device when the paper passes through the predetermined component, based on the information related to the whiteness, wherein the information related to the whiteness is the whiteness of the paper, and the step of determining the amount of damage includes determining that when the whiteness of the paper is lower than a predetermined value, the amount of damage caused by the paper to the predetermined component is relatively small and, when the whiteness of the paper is higher than or equal to the predetermined value, the amount of damage caused by the paper to the predetermined component is relatively large.

18. The damage amount determination method according to claim 17, further comprising:

a lifetime determination step of determining a lifetime of the predetermined component based on the amount of damage determined in the step of determining the amount of damage.

19. The damage amount determination method according to claim 17, further comprising:

a paper powder amount detection step of detecting an amount of paper powder generated when the paper passes through a predetermined position in the image forming device, wherein in the step of determining the amount of damage, the amount of damage caused by the paper to the predetermined component is determined based on the information related to the whiteness and the amount of paper powder.

20. A damage amount determination device used for an image forming device that forms an image on paper, the damage amount determination device comprising:

an information acquisition unit that acquires information related to whiteness of the paper used for printing; and a damage amount determination unit that determines an amount of damage, which is caused by the paper to a predetermined component of the image forming device when the paper passes through the predetermined component, based on the information related to the whiteness, wherein the information related to the whiteness is an ISO whiteness of the paper.

* * * * *